United States Patent [19]

Kern et al.

[11] Patent Number: 4,639,598

[45] Date of Patent: Jan. 27, 1987

[54] FIRE SENSOR CROSS-CORRELATOR CIRCUIT AND METHOD

[75] Inventors: Mark T. Kern, Goleta; Kenneth A. Shamordola, Santa Barbara, both of Calif.

[73] Assignee: Santa Barbara Research Center, Goleta, Calif.

[21] Appl. No.: 735,039

[22] Filed: May 17, 1985

[51] Int. Cl.[4] ..... G08B 17/12

[52] U.S. Cl. ..... 250/339; 250/340; 340/578

[58] Field of Search ..... 250/339, 340, 349; 340/578, 587

[56] References Cited

U.S. PATENT DOCUMENTS 4,469,944 9/1984 Kern et al. ..... 250/339

*Primary Examiner*—Carolyn E. Fields

*Attorney, Agent, or Firm*—Ronald L. Taylor; A. W. Karamebelas

[57] ABSTRACT

A cross-correlation fire sensor circuit includes detectors responsive to heat and light radiation, respectively. Electrical signals from the detectors are processed in two distinct channels through low pass filters and samplers. The sampled signals from the two channels are multipled together and the products are summed over a selected interval to provide a correlation function. This function is compared with an adjustable threshold to provide an indication of fire sensing. The circuit is also included as an adjunct to an existing system to provide improved sensitivity for fire sensing in the presence of noise and enhanced discrimination against false alarms. A ratio window detector circuit is disclosed as an alternative cross-correlator for detected radiation.

36 Claims, 6 Drawing Figures

FIRE SENSOR CROSS-CORRELATOR CIRCUIT AND METHOD

BACKGROUND OF THE INVENTION

1. Field of the Invention

This invention relates to fire sensing systems and, more particularly, to such systems particularly designed to discriminate between stimuli from fire and non-fire sources.

2. Description of the Related Art

Sensing the presence of a fire by means of photoelectric transducers is a relatively simple task. This becomes more difficult, however, when one must discriminate reliably between stimuli from a natural fire and other heat or light stimuli from a non-fire source. Radiation from the sun, ultraviolet lighting, welders, incandescent sources and the like often present particular problems with respect to false alarms generated in fire sensing systems.

It has been found that improved discrimination can be developed by limiting the spectral response of the photodetectors employed in the system. Pluralities of signal channels having different spectral response bands have been employed in a number of prior art systems which utilize different approaches to solving the problem of developing suitable sensitivity for fire sensing while reliably discriminating against non-fire stimuli. The disclosed solutions, however, have not generally realized the degree of effectiveness which is required for a successful and reliable fire sensing system that is not unduly subject to generating false alarms.

The Cinzori U.S. Pat. No. 3,931,521 discloses a dual-channel fire and explosion detection system which uses a long wavelength radiant energy responsive detection channel and a short wavelength radiant energy responsive channel and imposes a condition of coincident signal detection in order to eliminate the possibility of false triggering. Cinzori et al U.S. Pat. No. 3,825,754 adds to the aforementioned patent disclosure the feature of discriminating between large explosive fires on the one hand and high energy flashes/explosions which cause no fire on the other.

U.S. Pat. No. 4,296,324 of Kern and Cinzori discloses a dual spectrum infrared fire sensing system in which a long wavelength channel is responsive to radiant energy in a spectral band greater than about 4 microns and a short wavelength channel which is responsive to radiant energy in a spectral band less than about 3.5 microns, with at least one of the channels responsive to an atmospheric absorption wavelength which is associated with at least one combustion product of the fire or explosion to be detected.

McMenamin, in U.S. Pat. No. 3,665,440 discloses a fire detector utilizing ultraviolet and infrared detectors and a logic system whereby an ultraviolet detection signal is used to suppress the output signal from the infrared detector. Additionally, filters are provided in series with both detectors to respond to fire flicker frequencies of approximately 10 Hz. As a result, an alarm signal is developed only if flickering infrared radiation is present. A threshold circuit is also included to block out low level infrared signals, as from a match or cigarette lighter, and a display circuit is incorporated to prevent spurious signals of short duration from setting off the alarm. However, such a system may be confused by other flickering sources as simple and common as sunlight reflected off a shimmering lake surface or a rotating fan chopping sunlight or light from an incandescent lamp.

Muller, in U.S. Pat. Nos. 3,739,365 and 3,940,753, discloses dual-channel detection systems utilizing photoelectric sensors respectively responsive to different spectral ranges of incident radiation, the signals from which are filtered for detection of flicker within a frequency range of approximately 5 to 25 Hz. A difference amplifier generates an alarm signal in one of these systems when the signals in the respective channels differ by more than a predetermined amount from a selected value or range of values. In the other system, the output signals from the difference amplifier are applied to a phase comparator with threshold circuitry and time delay. An alarm signal is provided only if the input signals are in phase, of amplitude in excess of the threshold level, and of sufficient duration to exceed the preset delay. However, such a system may be ineffective in discriminating against non-fires, such as a jet engine exhaust (which has a flicker content), in the presence of scintillating or cloud-modulating sunlight.

The Paine U.S. Pat. No. 3,609,364 utilizes multiple channels specifically for detecting hydrogen fires on board a high altitude rocket with particular attention directed to discriminating against solar radiation and rocket engine plume radiation.

The Muggli U.S. Pat. No. 4,249,168 utilizes dual channels respectively responsive to wavelengths in the range of 4.1 to 4.8 microns and 1.5 to 3 microns. Signals in both channels are subjected to a bandpass filter with a transmission range between 4 and 15 Hz for flame flicker frequency response. Both channels are connected to an AND gate so that coincidence of detection in both channels is required for a fire alarm signal to be developed.

The Bright U.S. Pat. No. 4,220,857 discloses an optical flame and explosion detection system having first and second channels respectively responsive to different combustion products. Each channel has a narrow band filter to limit spectral response. Level detectors in each channel signal detected radiation in excess of selected threshold levels. A ratio detector provides an output when the ratio of signals in the two channels exceeds a certain threshold. When all three thresholds are exceeded by detected radiation, a fire signal is produced. One disclosed embodiment, FIG. 4, also uses a phase sensitive detector in each channel which is controlled from the other channel. This, however, is not a true cross-correlator and the performance of that embodiment in sensitivity to fires with suitable discrimination against false alarms has not been demonstrated in practice.

Other fire alarm or fire detection systems are disclosed in MacDonald U.S. Pat. No. 3,995,221, Schapira et al U.S. Pat. No. 4,206,454, Steel et al U.S. Pat. No. 3,122,638, Krueger U.S. Pat. Nos. 2,722,677 and 2,762,033, Lennington U.S. Pat. No. 4,101,767, Tar U.S. Pat. No. 4,280,058, and Nakauchi U.S. Pat. Nos. 4,160,163 and 4,160,164.

Despite the abundance of systems in the related art for fire detection, the fact remains that no system has proved to be fully effective in discriminating against false alarms. In those systems where sensitivity is enhanced, there appears to be a concomitant degradation in other performance parameters, such as false alarm immunity. The present invention is directed to techniques for improving small fire detection sensitivity without sacrificing performance in other respects.

SUMMARY OF THE INVENTION

In brief, arrangements in accordance with the present invention provide a true cross-correlation of two detector signals by comparing signal polarity, first derivative, second derivative, signal ratio and other signal properties to insure that both detector signals are responding to the same source. Since the invention requires that all detector signals be correlated as coming from the same source, jet engine exhaust in the presence of sunlight, for example, does not generate a response. Cross-correlation circuitry of the present invention may be used independently to provide effective fire detection or it may be used as an adjunct to other fire detection systems such as those of Cinzori U.S. Pat. No. 3,825,754 or Bright U.S. Pat. No. 4,220,857, mentioned hereinabove, or the system of our prior application Ser. No. 592,611, filed 3-23-84, entitled "Dual Spectrum Frequency Responding Fire Sensor", assigned to the assignee of the present application, in order that other criteria besides signal correlation are utilized to generate a fire sensor output signal. In particular, the combination of the present cross-correlation circuitry with such other systems improves the immunity against false alarms for such systems.

Lathi, in "Signals, Systems and Communication", (Wiley 1965), Chapter 12, defines the cross-correlation function, $\phi_{12}$, of signals $f_1$ and $f_2$ as:

$$\phi_{12}(\tau) = \int_{-\infty}^{\infty} f_1(t+\tau) f_2(t) dt \quad (1)$$

where $\tau$ is a "searching" or "scanning parameter" to look for phase delays between $f_1$ and $f_2$. For the instant fire sensor application, $\tau=0$ (as contrasted with applications such as radar pulse and return signal correlation, where $\tau \neq 0$). Modifying Equation (1) for the instant fire sensor application:

$$\phi_{12}(0) = \int_{-\infty}^{\infty} f_1(t) f_2(t) dt \quad (2)$$

This integration can be performed by digital computers, utilizing numerical techniques as described by Lathi in Chapter 10. By sampling often enough over a given interval, multiplying $f_1$ times $f_2$ at the sample points, and thereafter summing together all products over the given interval, the integration is approximated. The more samples there are and the longer the given interval, the better the approximation.

If the digital integration approximation of Lathi is rigorously followed, a fairly large memory is required in order to store all of the $f_1 \cdot f_2$ products which are necessary for summing the correlation function. A simplified operation can be performed which requires much less memory space by resorting to an equivalent Taylor series or Maclaurin series to expand the respective functions $f_1$, $f_2$ by involving derivatives of these functions. For example, the Maclaurin series expansion of $f_2$ is:

$$f_2(t) = f_2(0) + t \cdot f_2'(0) + t^2/2! \cdot f_2''(0) + t^3/3! \cdot f_2'''(0) \quad (3)$$

In one particular arrangement in accordance with the present invention, a cross-correlation detector circuit is provided which cross correlates the signals between relatively widely separated wavelengths in a range below 2.0 microns (representing light) and above 4.0 microns (representing heat). The electrical signal bandwidth is limited to from 0.2 to 5 Hz for obtaining the cross-correlation function for the reason that the light signal has more higher frequency components than has the heat signal and therefore less correlation would result at higher frequencies.

In this embodiment, sampling of $f_1$ (the heat signal) and $f_2$ (the light signal) is conducted at a 100 Hz rate. Prior to sampling, $f_1$ and $f_2$ are filtered with a low pass filter to 5 Hz. Each sample pair is then multiplied to obtain the product of the two paired sample signals at the time of sampling. These products are stored in memory on a first in, first out (FIFO) basis such that only the most recent five seconds worth of data is retained. To obtain $\phi_{12}$, the most recent 500 samples are then summed.

In an alternative arrangement in accordance with the present invention, utilizing the principle of expanding the functions in a Maclaurin series, as mentioned hereinabove, a digital output is developed for each channel from a corresponding channel comparator which is referenced to 0. The digital output state is a+1 or a−1 as determined by the filtered signal polarity. The digital signals are applied to an exclusive OR gate, the output of which is applied to an inverter. The filtered signals are also applied through successive stages of differentiation, with a corresponding comparison of the derivatives being performed at each stage. As with the outputs from the comparators for the original filtered signals, comparator outputs for each stage of differentiation are applied to respective exclusive OR gates and inverters. The outputs of all of the inverters are applied to an AND gate.

In the presence of noise, it may be expected that not all derivative polarities will agree, even if the original signal pair, before the addition of noise, consists of two identical signals. Therefore, the AND gate output may toggle between two states (1 and 0), but the duty cycle will provide an indication of percentage of correlation. The output of the AND gate is applied to a smoothing filter with a time constant of several seconds, thereby producing a slowly varying analog signal which is compared to a fixed threshold reference to create a final binary decision as to the sensing of an actual fire, independent of the absolute magnitude of the sensed input signals.

In another particular arrangement, a cross-correlation detector of the type described immediately hereinabove is combined with a fire sensing circuit of the type disclosed in our co-pending application Ser. No. 592,611, the contents of which are incorporated herein by reference in their entirety.

The particular arrangements so far described have the characteristic that they function without regard to the relative or absolute amplitudes of the two input signals. This is because the polarities of the signals and their derivatives are unaffected by amplification and attenuation. However, a more discriminating type of cross-correlation detector may be obtained by comparing the amplitudes of the signals and their derivatives in such a way that correlation is evaluated on the basis of the degree of similarity of the amplitudes of the signals and/or their derivatives. One such implementation, herein referred to as a "ratio window detector", delivers a logical TRUE output whenever the lesser of two inputs is greater than a fixed fraction of the greater. For example, if the fixed fraction were one-half, the circuit would generate a logical TRUE output when the lesser was between 50% and 100% of the greater. The fixed fraction is an adjustable parameter which may be selected for any desired degree of discrimination for the pair of inputs being processed. This ratio window detector may replace or modify one or more of the comparator/exclusive OR gate/inverter combinations previously described.

BRIEF DESCRIPTION OF THE DRAWING

A better understanding of the present invention may be had from a consideration of the following detailed description, taken in conjunction with the accompanying drawing in which.

DESCRIPTION OF THE PREFERRED EMBODIMENTS

Figure 1:
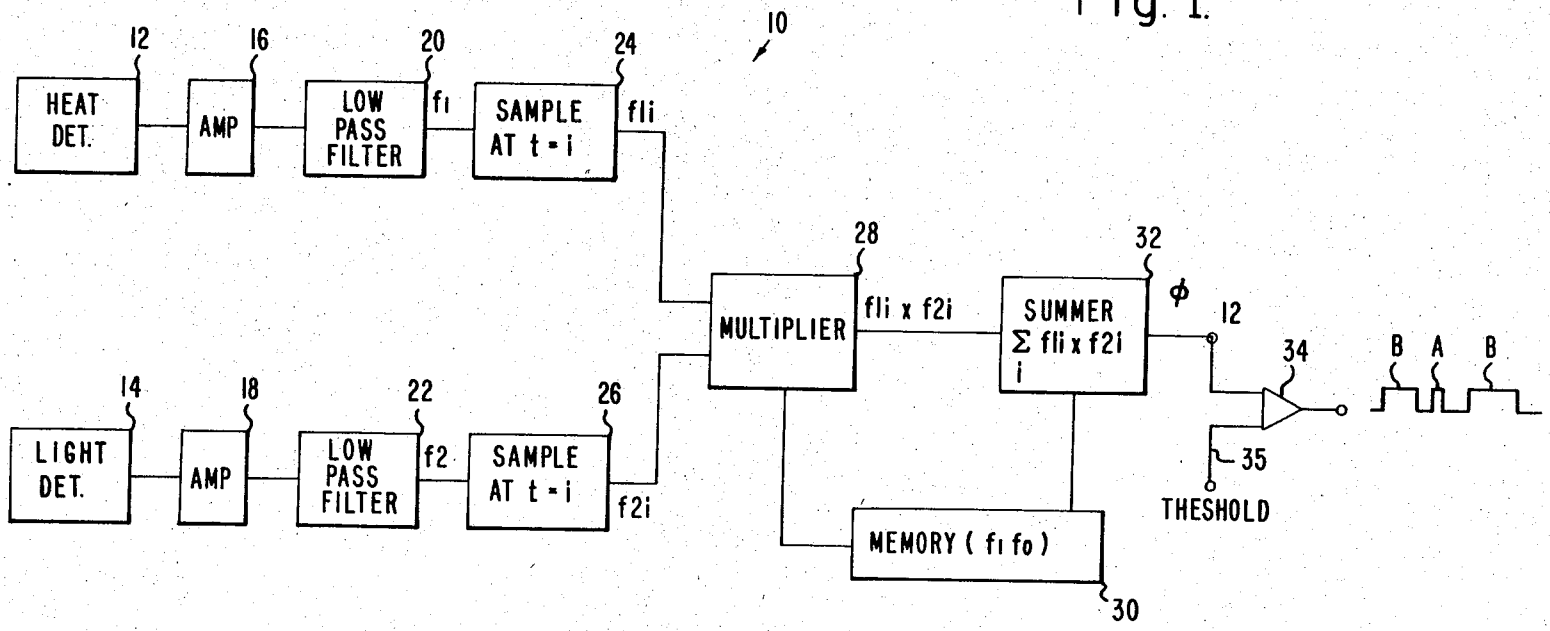
FIG. 1 is a block diagram of one particular arrangement in accordance with the present invention for performing a cross-correlation function.

In the cross-correlation circuit 10 represented in FIG. 1, a heat detector 12, adapted to respond to radiation at wavelengths above 4.0 microns, and a light detector 14, adapted to respond to radiation having a wavelength below 2.0 microns, are positioned to receive such radiation. The outputs of the detectors 12, 14 are applied to corresponding amplifiers 16, 18 and low pass filters 20, 22 arranged in respective signal channels. The resulting electrical signals ($f_1$ for incident heat radiation and $f_2$ for incident light radiation) are sampled at successive $t=i$ intervals by corresponding samplers 24, 26. The resulting signal samples $f_{1i}$, $f_{2i}$ are then applied as common inputs to a multiplier stage 28. The product of each $i^{th}$ sample pair ($f_{1i} \times f_{2i}$) is stored in a memory 30 on a first in, first out (FIFO) basis. The memory 30 has a capacity for five seconds worth of data. The output of this circuit, $\phi_{12}$, is taken from a summer stage 32 which develops a summation of the sample signal products stored in the memory 30 and the current, real time product from the multiplier 28. If it is desired or necessary to develop the correlation function $\phi_{12}$ without resort to a 500 sample memory, a lower sample rate of perhaps 10 to 20 Hz could be used without too much loss in accuracy of the cross-correlation function.

While the resulting $\phi_{12}$ signal at the output of the summer 32 may be used as a fire detection signal, it is possible that this signal may be affected by certain events which are unrelated to a fire. However, perturbations of this signal should not be as great as the signal changes which result from a well correlated $f_1$ and $f_2$, such as are caused by a fire. Furthermore, as the signal strength of $f_1$ and $f_2$ gets weaker and closer to detector noise, the $\phi_{12}$ signal component from random unrelated events can become significant, relative to the signal from a fire. To further improve the cross-correlation circuit of FIG. 1, a threshold circuit 34 is coupled to process the $\phi_{12}$ signal. The output of the stage 34 is a digital 1/0 signal which is TRUE if the signal $\phi_{12}$ exceeds the threshold value applied at 35 as an input to the threshold circuit 34, indicating correlation of the signals $f_1$ and $f_2$, and is false if $\phi_{12}$ is below the threshold value at 35, signifying lack of correlation of the signals $f_1$ and $f_2$. In practice, the digital output from the threshold circuit 34 will toggle back and forth occasionally. For example, a glint of sunlight peeking through clouds could be moving exactly in synchronism with the hot gases from a jet engine exhaust for a brief interval. Such an occurrence, while improbable, would cause the output to exceed its threshold briefly, as at A. This can readily be distinguished from fire signals, as at B, because of the difference in duty cycle.

Figure 2:
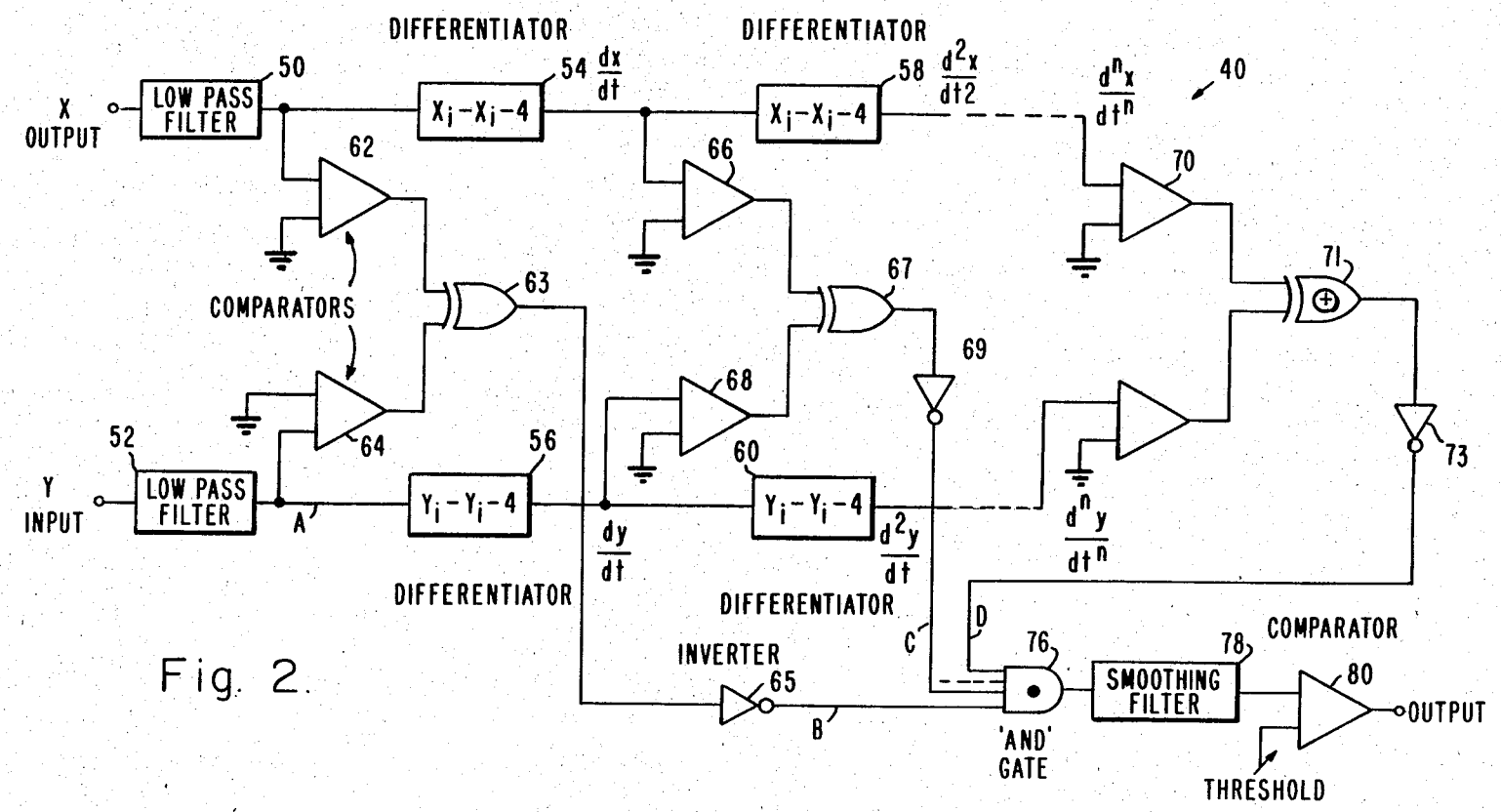
FIG. 2 is a block diagram of another particular arrangement in accordance with the present invention.

The block diagram of FIG. 2 represents a cross-correlator circuit 40 in accordance with the present invention which implements the Maclaurin series expansion of the functions $f_1$, $f_2$ as described above in connection with the expanded function of Equation (3). To utilize the series expansion of Equation (3) for the respective functions, it is not necessary to multiply out the sample signals point by point; instead, it is sufficient to simply evaluate the polarity of the dominant terms of the series expansion (i.e., the lower order terms).

The system 40 depicted in FIG. 2 comprises low pass filters 50, 52 receiving respective x and y input signals (corresponding to the sampled signals $f_{1i}$ and $f_{2i}$ of FIG. 1). A series of differentiators 54, 56 and 58, 60 are coupled in tandem in respective channels to the corresponding outputs of the low pass filters 50, 52. Respective pairs of comparators 62 and 64, 66 and 68, 70 and 72 are connected to compare the polarities of the signals being processed along the x and y signal channels. In each of the differentiator stages, a subtraction is performed between values at $t=i$ and $t=i-4$. The first differentiator in the x channel, the differentiator 54, develops a first derivative of x with respect to t. The succeeding differentiator 58 develops the second derivative of x with respect to t, etc. for as many differentiator stages as are employed. The $n^{th}$ differentiator develops the $n^{th}$ derivative of x with respect to t. Similar differentiators occur in the y signal channel.

The outputs of the comparators 62, 64 are applied to an exclusive OR gate which is in series with an inverter 65. Similar arrangements are provided for succeeding pairs of comparators—exclusive OR gate 67 and inverter 69 for comparators 66, 68; exclusive OR gate 71 and inverter 73 for comparators 70, 72. The outputs from all of the inverters 65, 69, 73 are applied to an AND gate 76. A smoothing filter 78 is coupled to the output of the AND gate 76, and its output is applied to a threshold comparator 80.

In the operation of the circuit of FIG. 2, at each stage, the comparator for each channel (62 for x and 64 for y, for example), referenced to 0 signal, gives a digital output whose state is determined by the filtered signal polarity. The output of the associated exclusive OR gate, such as 63, is TRUE whenever the comparator outputs are opposite and is false whenever the comparator outputs agree. The inverse of this signal (B at the output of inverter 65) is an indicator that the input signals have like polarity.

Differentiation of the smoothed inputs is performed by taking the difference between samples separated in time by four sample intervals. The purpose of this, as compared with using adjacent samples, is to further reduce the effects of random noise excursions which may only affect a single sample or two. The derivative polarities are compared in a manner similar to that with respect to the smoothed input signals, giving another logic signal indicative of equality of polarity, this time of the first derivative or slope. Similarly, higher derivatives may be obtained, compared, and the results combined for an increasingly restrictive criterion for correlation.

In the presence of noise, it may be expected that not all derivative polarities will agree, even if the original signal pair, before the addition of noise, consisted of two identical signals. The AND gate 76 output would therefore toggle between two states (1 and 0) but the duty cycle will be an indication of percentage of correlation. The smoothing filter 78, which has a time constant of several seconds, produces a slowly varying analog signal which is compared with a fixed threshold in the threshold comparator 80 to create a final binary indication of sensed fire which is independent of the absolute magnitude of the input signals.

Figure 3:
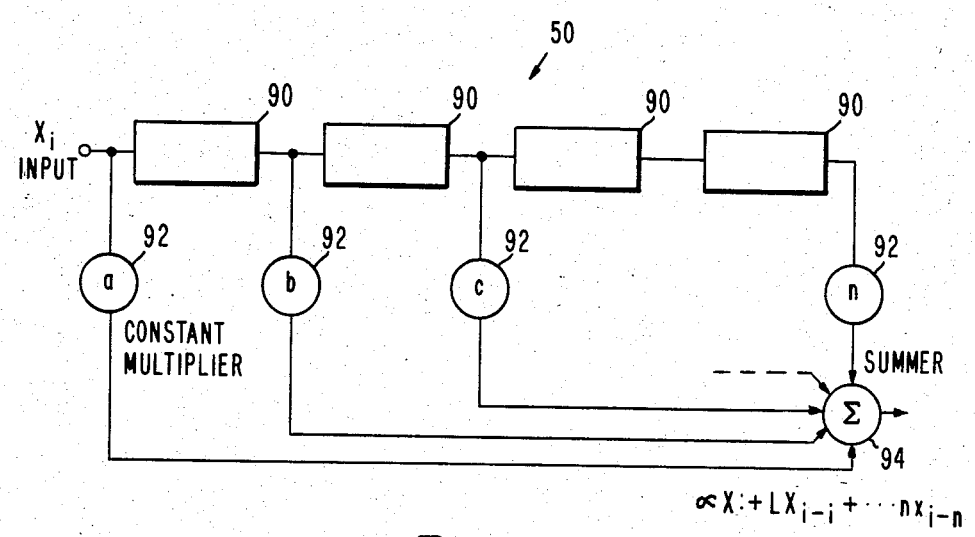
FIG. 3 is a block diagram of a particular type of digital filter utilized in the embodiment of FIG. 2.

The low pass filters 50, 52 of FIG. 2 preferably correspond to the block diagram represented in FIG. 3. The filter represented in FIG. 3 is a three-pole, low pass, Butterworth filter, sampling at 100 Hz. It is preceded in the circuit of FIG. 2 by the preamplifier roll-off below the Nyquist frequency of 50 Hz and followed by a general purpose smoothing algorithm to additionally reduce high frequency noise. This smoothing technique consists of calculating a weighted average of a fixed number of previous samples, thereby implementing a non-recursive digital filter. An example of such a procedure is provided in the circuit shown in FIG. 3. The filter of each channel (x channel in FIG. 3) includes a series of delay stages 90 connected in tandem. A constant multiplier 92 is connected to the channel before and after each delay stage, and the outputs of the constant multipliers a, b, c . . . n, are applied to a summing stage 94 which thus develops an output from the $x_i$ input of the form: $ax_i+bx_{i-1}+ \ldots nx_{i-m}$. For example, in one mechanization of FIG. 3 involving five multiple stages a . . . e, the coefficients were weighted in accordance with the standard binomial expansion coefficients such that $a=1$, $b=4$, $c=6$, $d=4$ and $e=1$ (n being e, m being 4 in the general expression). If the same overall amplitude is to be retained, the expression may be normalized by dividing each coefficient by the sum of the coefficients (15). This serves to smooth out the noise which is somewhat randomly distributed with the signals, thereby minimizing the effect of the noise.

Figure 4:
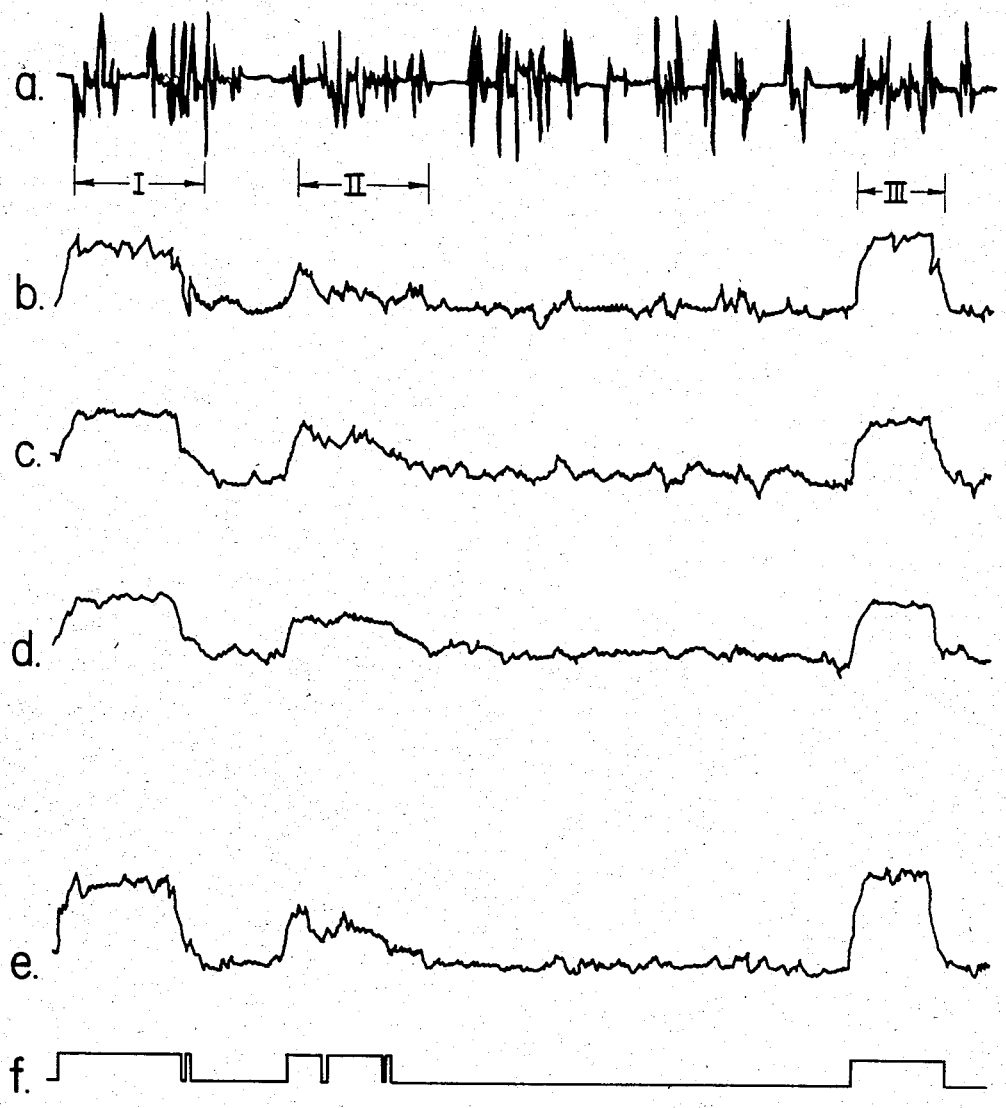
FIG. 4 is a series of waveforms developed from the operation of the embodiment of FIG. 2.

The waveforms of FIG. 4 correspond to signals in the cross-correlator circuit of FIG. 2. Waveform A is a 0.9 micron signal or particular incident light radiation, as would be present in the $f_2$ channel of FIG. 1. A similar signal would be present in the other channel but would be expected to correspond only in those portions of the signal waveform where correlation exists, normally by virtue of the signals having originated at the same source. Signals B, C and D represent the processing of the polarity comparison of the long versus short wavelength signals, their first derivatives and their second derivatives, respectively.

Those portions of signal waveform A (FIG. 4) designated by I, II and III represent standard pan fires at distances of 40 feet, 30 feet and 20 feet, respectively. The remainder of waveform A contains noise signals and cloud-modulated sunlight fluctuations which did not develop corresponding correlated signals in the other channel.

Each of the waveforms B, C and D contains portions corresponding to the pan fire signals in the regions I, II and III, as does waveform E which represents a composite of signals B, C and D, plus a third derivative term as seen at the output of smoothing filter 78 in FIG. 2. Waveform F represents the digital output from the threshold comparator 80 of FIG. 2. The threshold of the comparator stage 80 is adjustable and preferably is set for just below the average level of the signal E while a pan fire at 100 feet is present. As can be seen in FIG. 4, waveform F, the resulting cross-correlation function derived from the circuit of FIG. 4 is quite reliable for a signal in the presence of noise. The indications of sensing of fires at 40 feet, 30 feet and 20 feet are clear and definite.

Similar results are obtained for pan fires at distances in excess of 40 feet, particularly up to fires at 100 feet. Other systems with which embodiments of the present invention have been compared do not perform nearly as well. At shorter distances from the test fire, where detection is comparable, the ability of the other systems to discriminate against false alarms is lacking. As noted above, the waveform F is developed with the threshold of the threshold comparator 80 being set for just below the average level of the waveform E when a pan fire at 100 feet is present. Under these circumstances, when the two detectors are viewing the fire at 100 feet, the long wavelength detector signal is only 5 dB above detector noise.

Figure 5:
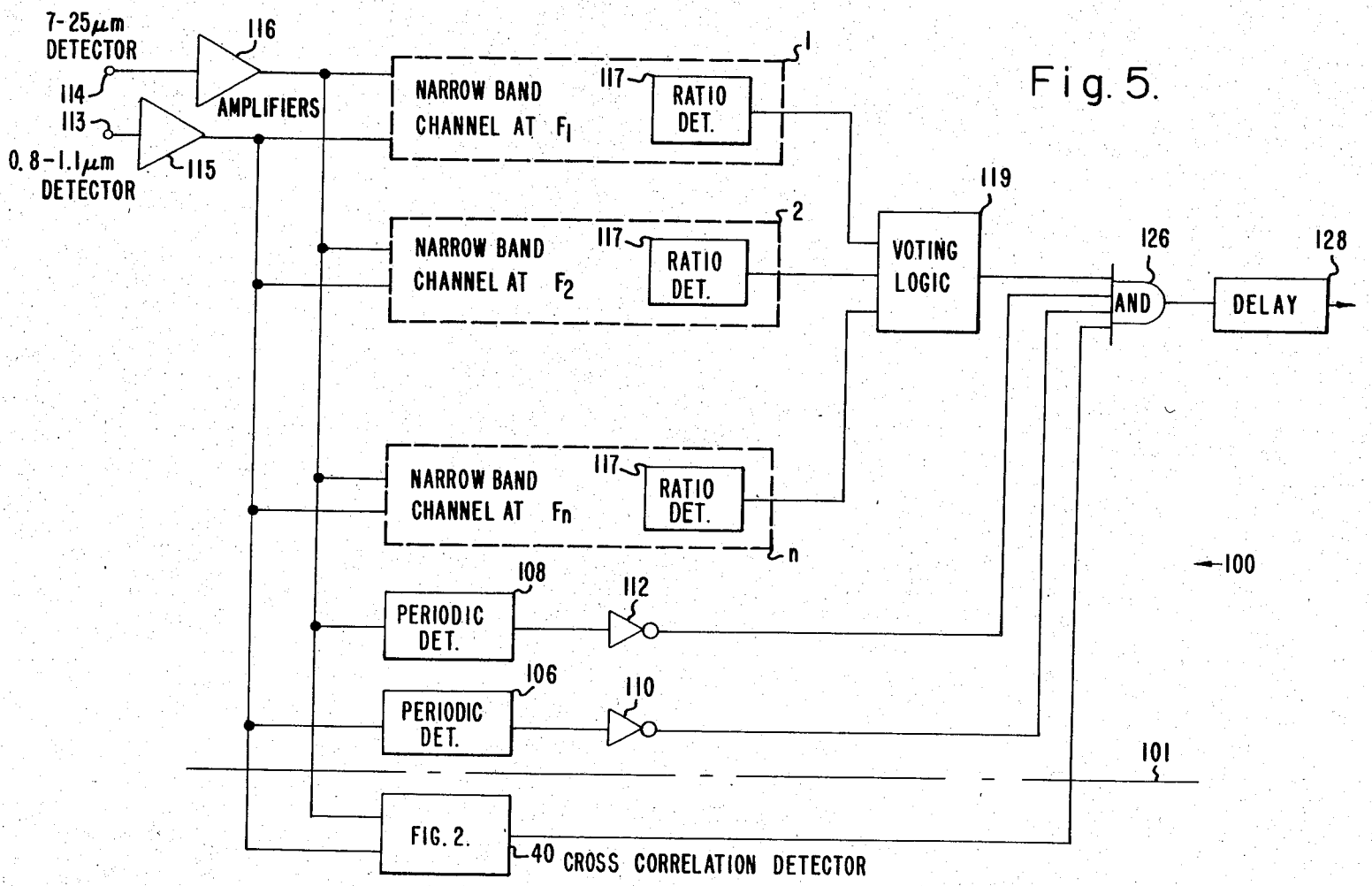
FIG. 5 is a block diagram of a fire sensing system incorporating the cross-correlation detector of FIG. 2.

FIG. 5 is a block diagram representing a cross-correlation detector 40, as shown in FIG. 2, coupled in combination with a dual-spectrum frequency responding fire sensor system 100 of our prior application Ser. No. 592,611, referenced above. The fire sensor 100, representing that portion of FIG. 5 above the broken line 101, corresponds generally to the embodiment depicted in FIG. 5 in our prior application. The system 100 includes n dual narrow band channels 1, 2 . . . n, each set at a different narrow band filter spectral passband $F_1$, $F_2 \ldots F_n$. It will be understood that each of the narrow band channels incorporates dual signal channels extending respectively from the amplifier 115 coupled to the short wavelength detector 113, responding to wavelengths in the range of 0.8 to 1.1 microns, and the amplifier 116 coupled to the long wavelength detector 114, responding to wavelengths in the range of 7 to 25 microns, and the ratio detector 117. (Alternatively the short wavelength detector may be set to respond to wavelengths in the range of 1.3 to 1.5 microns.) Each of these signal channels includes a narrow band filter, a full wave rectifier, and a low pass filter connected in series between the amplifiers 115 or 116, as the case may be, and the input of the ratio detector stage 117. As indicated in FIG. 5, the outputs of the ratio detectors 117 of the n narrow band channels 1, 2 . . . n are applied to a voting logic stage 119 which generates an output signal which is either TRUE or FALSE in accordance with the majority of the ratio detector output signals from the n narrow band channels. This output is connected as one input to an AND gate 126, the other inputs of which are the output of the cross-correlation detector 40 and signals from a pair of periodic signal detectors, to be described.

In addition to the narrow band channels for fire detection, a pair of periodic signal detectors 106, 108 are connected respectively to the amplifiers 115, 116 to develop another pair of channels for fire sensing. The periodic signal detectors provide additional protection against false alarms from a periodic or chopped (or generally non-random) non-fire source. Even though the output of the voting logic stage 119 for the n narrow band channels might be TRUE, indicating that a fire has been sensed according to that portion of the system, if one or the other of the periodic signal detectors 106, 108 identifies the sensed source as a chopped or periodic radiation source, this signal, by inversion in the appropriate inverter 110 or 112, will inhibit the AND gate 126 and develop a non-fire signal at the output of the gate 126.

The addition of the cross-correlation detector 40 provides, in the circuit of FIG. 5, further protection against a false fire alarm. This detector 40 compares the unprocessed radiometer output signals from the amplifiers 115, 116 and generates a logic signal which is TRUE when the degree of correlation between the two signals is above a preselected threshold, as described hereinabove with respect to the detector of FIG. 2. Thus, the cross-correlation detector 40 in FIG. 5 increases the likelihood of recognizing a flame flicker signal in an environment of high background radiation noise, such as sun flicker or moving hot objects, without increasing fire alarm sensitivity. It does this by measuring the degree to which radiation received in the two spectral regions (light and heat) fluctuates in unison. A flame tends to generate radiation which rises and falls at random across the entire blackbody spectrum. Thus, signals from the two radiation spectral regions which do not show sufficient correlation are considered to be from different sources and, hence, not a flame signal.

The delay stage 128 at the output of the AND gate 126 is provided with a time delay of several seconds and thus serves to smooth any short duty cycle signals at the output of the AND gate 126, further improving reliability of the system.

Figure 6:
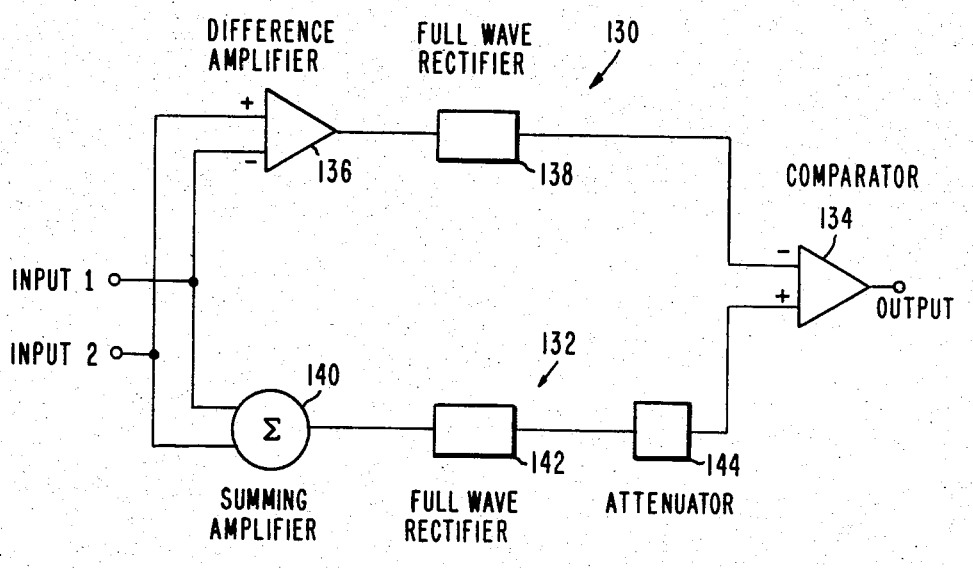
FIG. 6 is a block diagram of a ratio window detector circuit which may be incorporated in a variant of the arrangement of FIG. 2.

FIG. 6 is a block diagram illustrating one particular variation of the embodiment of the invention as shown in FIG. 2. Specifically, the circuit depicted in FIG. 6 is substituted for the comparators 62, 64, exclusive OR gate 63, and the inverter 65 in FIG. 2. Inputs 1 and 2 of FIG. 6 are connected to the outputs of the low pass filters 50, 52.

The circuit of FIG. 6 is shown comprising a pair of parallel signal channels 130, 132 coupled to receive signals on inputs 1 and 2, and to provide respective negative and positive channel output signals to a common comparator 134 connected to the output. The upper signal channel 130 comprises a difference amplifier 136 in series with a full wave rectifier 138. The lower signal channel 132 includes a summing amplifier 140 (gain equal to 0.5) coupled in series with a full wave rectifier 142 and an attenuator 144.

In this circuit, the absolute value of the difference between the two inputs 1 and 2 is formed by a difference amplifier 136 and full wave rectifier 138 in upper signal channel 130. Similarly, in the lower signal channel 132, the absolute value of the average of the two inputs 1 and 2 is formed with the summing amplifier 140 and the full wave rectifier 142. A fixed fraction of the average which is thus developed in lower signal channel 132 is taken from the attenuator 144 for comparison with the rectified difference from signal channel 130 in comparator 134. A logical TRUE output is generated by the comparator 134 as long as the rectified difference is the lesser value in the comparison. The fixed fraction from signal channel 132 may be relatively small, for example 1/10, for a highly restrictive correlation test, or it may be larger, for example ½, for a much less restrictive test. (For a fixed fraction of 1/10, the two inputs would be required to be within 10% of each other in amplitude.)

The circuit of FIG. 6 is referred to herein as a "ratio window detector", so-called because it develops a fire sense output signal in response to a "window" which is determined by a preselected ratio for the input signals being processed. As mentioned, the degree of restrictiveness of the correlation test (the extent of the "window") is controlled by the ratio selected.

The ratio window detector circuit of FIG. 6 may, if desired, be substituted for any or all of the comparator-/exclusive OR/inverter combinations in FIG. 2; specifically the elements 62–65, 66–69 and/or the elements 70–73 of the FIG. 2 block diagram.

Arrangements in accordance with the present invention as are shown and described hereinabove advantageously provide a fire sensing system with increased sensitivity and improved immunity against false alarms. One particular cross-correlation detector of the present invention has demonstrated the capability of sensing a one-square-foot pan of fuel burning at a distance of 100 feet and reliably protecting against the generation of false alarms from non-fire sources. This performance exceeded the capabilities of known related art systems with which comparisons were made.

Although there have been described above specific arrangements of an improved fire sensor cross-correlator circuit and method in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A cross-correlation circuit for fire sensing comprising:

first and second parallel signal channels for responding to long wavelength and short wavelength radiation, respectively;

said first channel including a short wavelength detector, an amplifier, a low pass filter, and signal sampling means coupled together in series;

said second signal channel including a long wavelength detector, an amplifier, a low pass filter and signal sampling means coupled together in series;

a signal multiplier stage coupled to receive the sampled signal outputs of the two signal channels and multiply sampled signals together by pairs; and means coupled to the output of said multiplier stage for summing the sampled pair products in order to develop a cross-correlation function signal corresponding to said signals from said signal channels which is indicative of the detection by both of said detectors of radiation from a fire source.

2. The apparatus of claim 1 wherein the means coupled to the multiplier stage includes storage means for temporarily storing individual products of pairs of sampled signals and for delivering the stored products in the order in which the signal products are received from the multiplier stage.

3. The apparatus of claim 2 wherein the means coupled to the multiplier stage further include a summing stage coupled to receive signals from the multiplier stage and from the storage means for providing said cross-correlation function signal as a summation of selected pair products.

4. The apparatus of claim 3 further including a threshold comparator coupled to the output of the summing stage for generating a fire sense signal when the cross-correlation function signal exceeds a preselected threshold.

5. The apparatus of claim 4 wherein the threshold of said threshold comparator is adjustable.

6. The apparatus of claim 1 wherein the spectral response ranges of the first and second detectors are spaced from each other.

7. A cross-correlator fire sensor circuit comprising:

a first detector adapted to generate an electrical signal in response to radiation of a first selected wavelength in a range above approximately 4.0 microns;

a second detector adapted to generate an electrical signal in response to radiation of a second selected wavelength in a range below approximately 4.0 microns;

first and second signal channels coupled respectively to the first and second detectors, each of said channels including a low pass filter in series with means for sampling the signals passed by the low pass filter; and means for cross-correlating sampled signals, by pairs, to develop a fire sense signal when the correlation between signal pairs exceeds a predetermined threshold level.

8. The apparatus of claim 7 wherein the first detector is adapted to respond to radiation in a range of 7 to 25 microns and the second detector is adapted to respond to radiation in a range from 0.8 to 1.1 microns.

9. The apparatus of claim 7 wherein each channel includes at least one differentiator stage and further including means coupled between the channels for determining the polarities of corresponding pairs of signals and derivatives thereof, and means for developing a fire sense signal upon the occurrence of like polarities of signals and derivatives thereof in both of said channels.

10. The apparatus of claim 9 wherein said cross-correlating means comprise a pair of comparators, one for each signal channel, coupled to receive a signal from the associated signal channel for comparison with a said predetermined reference level.

11. The apparatus of claim 10 wherein the outputs of said pair of comparators are applied jointly to an exclusive OR gate in series with an inverter for developing an output signal having a TRUE condition when the signals in both channels are of like polarity.

12. The apparatus of claim 11 wherein the cross-correlating means further comprise a pair of comparators coupled respectively to the outputs of the differentiator stages in the respective channels and a series combination of an exclusive OR gate and an inverter to develop a fire sense signal having a TRUE condition when the derivatives of the signals in said channels are of like polarity.

13. The apparatus of claim 12 further including an AND gate coupled to receive the outputs of said inverters and provide an output signal indicating a sensed fire upon the simultaneous occurrence of like polarities of signals and signal derivatives on said channels.

14. The apparatus of claim 13 further including a smoothing filter coupled to the output of said AND gate and a threshold comparator coupled to receive the output of the smoothing filter for developing a fire sense signal upon the application of a signal from the smoothing filter in excess of a predetermined threshold.

15. The apparatus of claim 14 wherein said threshold comparator includes a variable threshold level.

16. The apparatus of claim 7 wherein said cross-correlating means comprise a ratio window detector circuit having a preselected fixed fraction ratio, said ratio window detector circuit providing a fire sense signal upon the occurrence of a predetermined level of similarity between said sampled signals.

17. The apparatus of claim 16 wherein the ratio window detector circuit comprises first and second signal paths, the first path including a difference amplifier in series with a rectifier for providing an absolute difference of the sampled signals, the second path comprising a summing amplifier in series with a rectifier and an attenuator for providing a fixed fraction ratio of the absolute average of the sampled signals, and a comparator coupled to the outputs of the two signal paths for developing a TRUE condition output when the output from the first signal path is less than the output from the second signal path.

18. The apparatus of claim 17 wherein each signal channel includes at least one differentiator stage and further including a second ratio window detector circuit coupled between the channels at the outputs of said differentiator stages for developing a TRUE condition output from said second ratio window detector circuit upon the occurrence of a predetermined level of similarity betweem derivatives of said sampled signals, and means for developing a fire sense signal upon the concurrence of TRUE condition outputs from the first and second ratio window detector circuits.

19. The apparatus of claim 7 wherein said signal channels comprise a plurality of differentiation and comparison stages, each stage including a serially connected differentiator in each channel and comparators coupled to the output of the respective differentiators for comparing the differentiator outputs with a predetermined reference level, and an exclusive OR gate in series with an inverter coupled to receive the outputs of the comparators and signal a TRUE condition upon the occurrence of like polarity signals at the inputs of the comparators.

20. The apparatus of claim 19 further including means for combining the outputs of the respective inverters for developing a TRUE condition signal when all of the inverter outputs assume a TRUE condition.

21. The apparatus of claim 20 further including means for comparing the output of said combining means with a predetermined threshold level and developing a fire sense output signal upon said combining means output exceeding said threshold level.

22. The apparatus of claim 7 further including a fire sensor circuit including a plurality of narrow band channels set at selected different frequencies, each being coupled to the first and second detectors for developing an independent fire sense signal, and means for combining the output of the narrow band channel sensing circuit with the fire sense signal from the cross-correlation detector to provide an output signal when both fire sense signals are present concurrently.

23. The apparatus of claim 22 further including a pair of periodic signal detectors coupled respectively to said first and second detectors for providing output signals corresponding to the detection of radiation of the periodic type, and means for combining the outputs of the narrow band circuit, the periodic signal detectors and the cross-correlation detector to provide an output signal if, and only if, the outputs assume a true condition.

24. The apparatus of claim 7 further including a signal multiplier stage coupled to receive the sampled signal outputs of the two signal channels and multiply said sampled signals together by pairs, and means coupled to the output of said multiplier stage for summing the sampled pair products in order to develop a cross-correlation function signal corresponding to said signals from said signal channels which is indicative of the detection by both of said detectors of radiation from a fire source.

25. The apparatus of claim 24 wherein the means coupled to the multiplier stage includes storage means for temporarily storing individual products of pairs of sampled signals and for delivering the stored products in the order in which the signal products are received from the multiplier stage.

26. The apparatus of claim 25 wherein the means coupled to the multiplier stage further include a summing stage coupled to receive signals from the multiplier stage and from the storage means for providing said cross-correlation function signal as a summation of selected pair products.

27. The apparatus of claim 26 further including a threshold comparator coupled to the output of the summing stage for generating a fire sense signal when the cross-correlation function signal exceeds a preselected threshold.

28. The apparatus of claim 27 wherein the threshold of said threshold comparator is adjustable.

29. The apparatus of claim 28 wherein the spectral response ranges of the first and second detectors are spaced from each other.

30. The method of sensing a fire from incident radiation in wavelength ranges respectively above and below 4.0 microns comprising the steps of:

detecting short wavelength radiation in the range of 0.8 to 1.1 microns;

detecting long wavelength radiation in the range of 7 to 25 microns;

processing signals from detected radiation in separate signal channels, one for each wavelength range, wherein each signal channel includes a low pass filter;

sampling the signals at the outputs of the respective low pass filters in the separate channels; and further processing said signals by sample pairs and generating a fire sense signal upon the occurrence of a correlation between corresponding pairs of signals.

31. The method of claim 30 further including the step of multiplying sampled signals together by pairs and summing a plurality of pairs of signals to develop an output signal corresponding to the cross-correlation function of the signals from detected radiation.

32. The method of claim 31 further including the step of storing successive pairs of sampled signals in memory on a first-in, first-out basis and summing a plurality of the stored signal pairs to develop the cross-correlation function.

33. The method of claim 30 further including the step of comparing signals at corresponding points in the respective signal channels with a zero reference level and developing a signal indicative of a sensed fire when said corresponding signals are of like polarity.

34. The method of claim 33 further including the steps of performing successive differentiations of signals along said signal channels, comparing the corresponding derivatives from each stage of differentiation in the two channels with a zero reference level, and providing an output signal indicative of a sensed fire when compared derivatives are of like polarity.

35. The method of claim 34 further including the step of combining all of said sensed fire output signals and providing a TRUE fire signal only upon the concurrence of all of said sensed fire output signals.

36. The method of claim 30 further including the steps of taking the absolute difference of said sample pairs, taking the absolute average of said sample pairs and comparing the absolute difference values with a predetermined fractional portion of the absolute average values to develop a TRUE condition output when the absolute difference value is less than said fractional portion of the absolute average value.

* * * * *